US008068081B2

(12) United States Patent
Wang et al.

(10) Patent No.: US 8,068,081 B2
(45) Date of Patent: Nov. 29, 2011

(54) DRIVER FOR DRIVING DISPLAY PANEL AND METHOD FOR READING/WRITING IN MEMORY THEREOF AND THIN FILM TRANSISTOR LIQUID CRYSTAL DISPLAY USING THE SAME

(75) Inventors: Ying-Chi Wang, Hsinchu (TW); Chun-Hung Huang, Hsinchu (TW); Heng-Sheng Chou, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 992 days.

(21) Appl. No.: 11/690,847

(22) Filed: Mar. 25, 2007

(65) Prior Publication Data

US 2008/0170050 A1 Jul. 17, 2008

(30) Foreign Application Priority Data

Jan. 15, 2007 (TW) ..... 96101402 A

(51) Int. Cl.
*G09G 3/36* (2006.01)

(52) U.S. Cl. ..... 345/98; 345/204; 345/540; 345/545; 348/539; 348/540

(58) Field of Classification Search ..... 345/87, 345/92, 98, 540, 545, 547, 204; 348/550, 348/539, 540
See application file for complete search history.

(56) References Cited

U.S. PATENT DOCUMENTS

| | | | | |
|---|---|---|---|---|
| 4,298,888 | A * | 11/1981 | Colles et al. | 348/446 |
| 5,428,723 | A * | 6/1995 | Ainscow et al. | 345/634 |
| 6,271,821 | B1 * | 8/2001 | Sung et al. | 345/98 |
| 6,473,077 | B1 * | 10/2002 | Takenaka et al. | 345/209 |
| 6,954,195 | B2 | 10/2005 | Yoneda et al. | |
| 2002/0135548 | A1 * | 9/2002 | Moon | 345/75.2 |
| 2002/0167473 | A1 * | 11/2002 | Johnson et al. | 345/76 |
| 2004/0008281 | A1 * | 1/2004 | Jeffrey et al. | 348/607 |

FOREIGN PATENT DOCUMENTS

| | | |
|---|---|---|
| CN | 1744194 | 3/2006 |
| JP | 2005-286746 | 10/2005 |

* cited by examiner

*Primary Examiner* — Amare Mengistu
*Assistant Examiner* — Koosha Sharifi-Tafreshi
(74) *Attorney, Agent, or Firm* — Jianq Chyun IP Office

(57) ABSTRACT

A driver for driving a display panel and a method for reading/writing in a memory thereof and thin film transistor liquid crystal display (TFT-LCD) using the same are provided. The method of the present invention is a reading timing of memory which different than the prior reading timing of memory, so that, if using the method of the present invention in the driver even having only one memory, the tearing effect of the prior TFT-LCD can be solved and the whole power consumption thereof can also be reduced.

17 Claims, 8 Drawing Sheets

DRIVER FOR DRIVING DISPLAY PANEL AND METHOD FOR READING/WRITING IN MEMORY THEREOF AND THIN FILM TRANSISTOR LIQUID CRYSTAL DISPLAY USING THE SAME

CROSS-REFERENCE TO RELATED APPLICATION

This application claims the priority benefit of Taiwan application serial no. 96101402, filed Jan. 15, 2007. All disclosure of the Taiwan application is incorporated herein by reference.

BACKGROUND OF THE INVENTION

1. Field of the Invention

The present invention relates to a driver for driving the display panel and a method for reading/writing in memory thereof and thin film transistor liquid crystal display (TFT-LCD) using the same, in particular, to a driver for driving the display panel and a method for deferring to read/write in memory thereof and thin film transistor liquid crystal display (TFT-LCD) using the same.

2. Description of Related Art

The rapid development of multimedia has most probably benefited from the great advancement of semiconductor module or display apparatus. As to display, the TFT-LCD with high definition, preferred space utilization, low power consumption, and no radiation has gradually become the mainstream of the market.

Generally speaking, in a conventional driving structure of the TFT LCD, the AC mode common voltage driving structure (for example, the line inversion display technology) is usually applied to middle size or small size TFT-LCD (that is to say, apply the AC common voltage to the common electrode), and the DC mode common voltage driving structure (for example, the dot inversion display technology) is usually applied to big size TFT-LCD (that is to say, apply the DC common voltage to the common electrode).

The video signal transmitting method of the display panel in the conventional TFT-LCD is the sequence transmitting method, namely, all the scan lines in the display panel are driven for turning on respectively by the scan signal outputted from the gate driver so as to receive the video input data signal provided by the driver. This kind of transmitting method is so-called non-interlaced scanning.

However, if said non-interlaced scanning video transmitting method and the line inversion display technology are used at the same time, the whole power consumption will be increased because the AC common voltage applied to the common electrode will be inverted on each scan line.

In order to reduce the whole power consumption of the TFT-LCD, it's an existing way that using non-sequence transmitting method as the video transmitting method of the display panel in the TFT-LCD instead of sequence transmitting method. This kind of transmitting method is so-called interlaced scanning. Thereby if the interlaced scanning video transmitting method and the line inversion display technology are used at the same time, the AC common voltage applied to the common electrode will only be inverted on each frame, so it can be understand that the whole power consumption of the TFT-LCD will be significantly reduced.

Although said method for reducing the whole power consumption of the TFT-LCD can gain the corresponding effect, the new concomitant question is a tearing effect which occurs at the time of the video animation frame is being displayed on the TFT-LCD. The tearing effect can be simply described that a part of (almost 50%) video input data of the prior video frame will be remained when the recent video frame is being displayed on the TFT-LCD, so as to the TFT-LCD displays an improper video frame.

The reason of the occurring of tearing effect which happened when interlaced scanning mode is used in the video transmitting method is that: in general, said driver include an memory which carry out an improper read mode when interlaced scanning is adopted, so the wrong data will be inputted into display panel and the TFT-LCD will display a wrong video frame to user watched.

It will be described as below that the method of reading/writing in conventional memory within driver when the non-interlaced scanning mode is used in the video transmitting method of the display panel in the TFT-LCD.

Firstly, FIG. 1 is a diagrammatic drawing showing the non-interlaced scanning mode of the display panel 101 in the conventional TFT-LCD 100. Referring to FIG. 1, it is clearly disclosed that the display panel 101 includes 320 scan lines SL. The display panel 101 is driven by gate driver 103 with a non-sequential mode to turn on the scan lines SL and corresponding to receive the video input data provided by the driver 105.

In brief, the gate driver 103 will firstly turn on all of the odd scan lines SL (1, 3, 5, . . . , 319) of the display panel 101 sequentially and then turn on all of the even scan lines SL (2, 4, 6, . . . , 320) of the display panel 101 sequentially. This kind of driving method will separate one frame period in the display panel 101 into odd field and even field. The odd field and even field can be combined together to form a so-called "frame".

FIG. 2 shows a read mode of the conventional memory 201 within the driver 105 for the first frame period when the display panel 101 adopts the interlaced scanning mode as video transmitting method. Referring to FIG. 1 and FIG. 2, when the interlaced scanning mode is adopted, the read mode of the memory 201 (for example, a SRAM) within the driver 105 is: firstly, writing sequentially video input data into the memory 201 from the first video input data D_in_1_1 to the $160^{th}$ video input data D_in_1_160, and at the same time, reading the video input data for odd field from memory 201 and transmitting it to the display panel 101.

It is clearly disclosed in FIG. 2 that when the fist video input data D_in_1_1 of the first frame is written into the memory 201 within the driver 105, the video input data D_out_1_1 is correctly outputted as the first video input data of the odd field. However, when the second video input data D_in_1_2 of the first frame is written into the memory 201 within the driver 105, an improper video input data is mistakenly outputted as the third video input data D_out_1_3 of the odd field because the third video input data D_out_1_3 hasn't been written into the memory 201 within the driver 105 heretofore.

It can be understood that unknown video input data are outputted from the third video input data D_out_1_3 to the $319^{th}$ video input data D_out_1_319 of the odd field. However, from the second video input data D_out_1_2 to the $320^{th}$ video input data D_out_1_320 of the even field, all the video input data of the even field will be correctly outputted because the data has been already written into the memory 201 within the driver 105 heretofore.

FIG. 3 shows the read mode of the conventional memory 201 within the driver 105 for the second frame period when the display panel 101 adopts the interlaced scanning mode as video transmitting method. Referring to FIG. 1~FIG. 3, after the reading/writing for the first frame is accomplished, the writing for the second frame will start from the first video input data D_in_2_1 to the $160^{th}$ video input data D_in_2_160 of the second frame, and the same time the video input data of the odd field will be read and outputted to the display panel 101.

It is clearly disclosed in FIG. 3 that when the fist video input data D_in_2_1 of the second frame is written into the memory 201 within the driver 105, the video input data D_out_2_1 is correctly outputted as the first video input data of the odd field. However, when the second video input data D_in_2_2 of the second frame is written into the memory 201 within the driver 105, the video input data D_out_1_3 which belongs to the first frame period is mistakenly outputted as the third video input data D_out_2_3 of the odd field.

It can be understood that improper video input data D_out_1_3~D_out_1_319 which belongs to the first frame are mistakenly outputted as the third video input data D_out_2_3 to the $319^{th}$ video input data D_out_2_319 of the odd field. However, from the second video input data D_out_2_2 to the $320^{th}$ video input data D_out_2_320 of the even field, all the video input data of the even field will be correctly outputted because the data has been already written into the memory 201 within the driver 105 heretofore.

In other words, it can be understood that when the video input data D_out_2_3~D_out_2_319 of odd field need to be read, actually, the video input data D_in_1_3~D_in_1_319 of the odd field which belongs to the first frame is read. Similarly, a part of (almost 50%) video input data of the prior video frame will be remained in the third frame, the fourth frame and so on, and it's the causation for said tearing effect.

In order to solve the tearing effect of the TFT-LCD, some people consider that it is feasible to add one more memory to the driver. For the driver has two memories, one memory process the reading operation, and the other memory process the writing operation. The two memories can read or write video input data alternately. This idea can resolve the tearing effect of the TFT-LCD. However, it is hard to set two memories in the driver because the two memories will occupy overfull area of the driver. In general, one memory will occupy 60% area of the driver, so it is unsatisfactory to set two memories in one driver. For this reason, said idea is only an assumption but cannot be applied in the conventional driver.

SUMMARY OF THE INVENTION

Accordingly, the present invention is directed to a method for reading/writing in memory and a driving method for display panel using the same. The method provides a special reading timing of memory which can solve the tearing effect of the prior TFT-LCD, even if the TFT-LCD using a driver which has only one memory.

The present invention is also directed to a driver for display panel using the above-described method for driving display panel, which has the same advantage as the above-described method.

The present invention is also directed to a display panel and a display using the same, which employed the above-described driver, which can solve the tearing effect of the prior TFT-LCD and reduce whole power consumption. Even when a video animation frame is being displayed, the display can display a proper video frame to user watched.

As embodied and broadly described herein. The method for reading/writing in a memory is provided by the present invention. The method includes the following steps of: firstly, sequentially writing M video input data outputted by a driver into the memory in a first period, where the M being a positive integer. After then, in the first period, when a $[(M/2)+1]^{th}$ video input data beginning to be written into the memory, the memory beginning to output an odd video input data which has been inputted in the first frame period.

In a preferred embodiment of the present invention, there is at least N blanking comprised in the first period, where N is a positive integer or zero.

From another point of view, the method for driving the display panel is provided by the present invention. The method includes the following steps of: firstly, sequentially writing M video input data outputted by a driver into a memory in a first frame period, where M being a positive integer. After then, in the first frame period, when a $[(M/2)+1]^{th}$ video input data beginning to be written into the memory, the memory beginning to output an odd video input data which has been inputted in the first frame period to the display panel.

From another point of view, the driver for driving the display panel is provided by the present invention. The driver includes a memory. The memory sequentially writes M video input data outputted by the driver thereof in a first frame period, where M being a positive integer. And then in the first frame period, when a $[(M/2)+1]^{th}$ video input data beginning to be written thereof, the memory begins to output the odd video input data which has been inputted in the first frame period to the display panel.

From another point of view, the display is provided by the present invention. The display includes a display panel and a driver, wherein the driver includes a memory. The memory sequentially writes M video input data outputted by the driver thereof in a first frame period. And then in the first frame period, when a $[(M/2)+1]^{th}$ video input data beginning to be written thereof, the memory begins to output the odd video input data which has been inputted in the first frame period to the display panel, where M being a positive integer.

In a preferred embodiment of the present invention, when a $M^{th}$ video input data has been written into the memory in the first frame period and after that a first video input data begins to be written into the memory in a second frame period, the memory begins to output the even video input data which has been inputted in the first frame period to the display panel.

In a preferred embodiment of the present invention, there is at least N blanking comprised in the first period, where N is a positive integer or zero.

The method for reading/writing in memory of the present invention can be applied in current memory within the driver of display panel, and the method for reading/writing in memory can derive from the method for driving display panel. According to the driving method, the video input data which has been inputted in the first frame period aren't outputted to the display panel immediately, in the first frame period, after half of video input data have been written into the memory, the memory begins to output the odd video input data which has been inputted in the first frame period. And then when the $M^{th}$ video input data have been written into the memory in the first frame period and after that the first video input data begins to be written into the memory in the second frame period, the memory begins to output the even video input data which has been inputted in the first frame period to the display panel.

Therefore, the method for reading/writing in memory with a reading timing of memory which different than the prior reading timing of memory, which can solve the tearing effect of the prior TFT-LCD, and is applied in memory (such as SRAM) within the driver of display panel. As the driver of display panel provided by the present invention uses the method for driving display panel, and the display panel and the display provided by the present invention are employed the driver of the present invention thereof, thus, the display of the present invention can reduce whole power consumption, and even when the recent video animation frame is being displayed, the display can display a proper video frame to user watched.

These and other exemplary embodiments, features, aspects, and advantages of the present invention will be described and become more apparent from the detailed description of exemplary embodiments when read in conjunction with accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
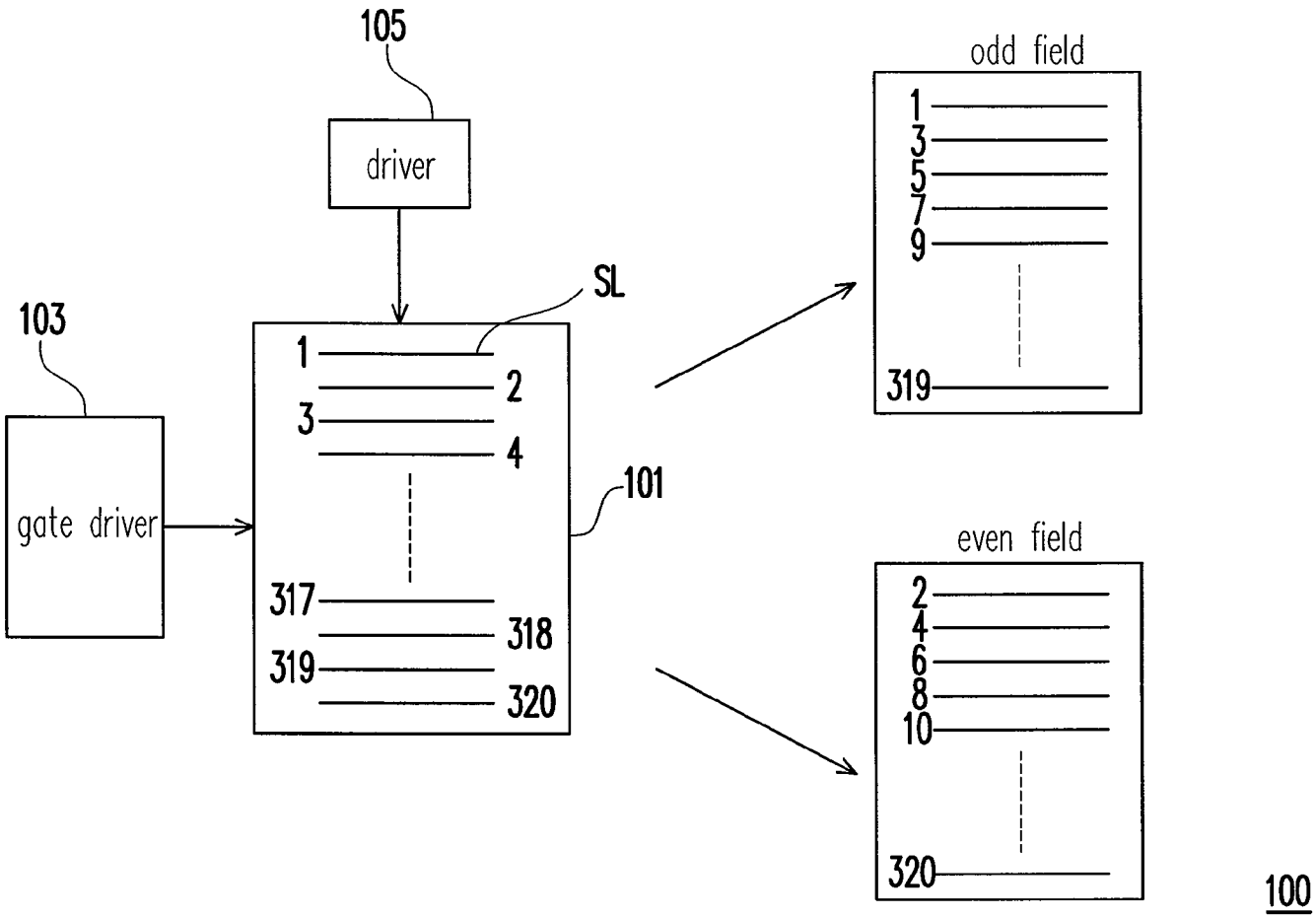
FIG. 1 (PRIOR ART)
FIG. 1 is a diagrammatic drawing showing the non-interlaced scanning mode of the display panel in the conventional TFT-LCD.
Figure 2:
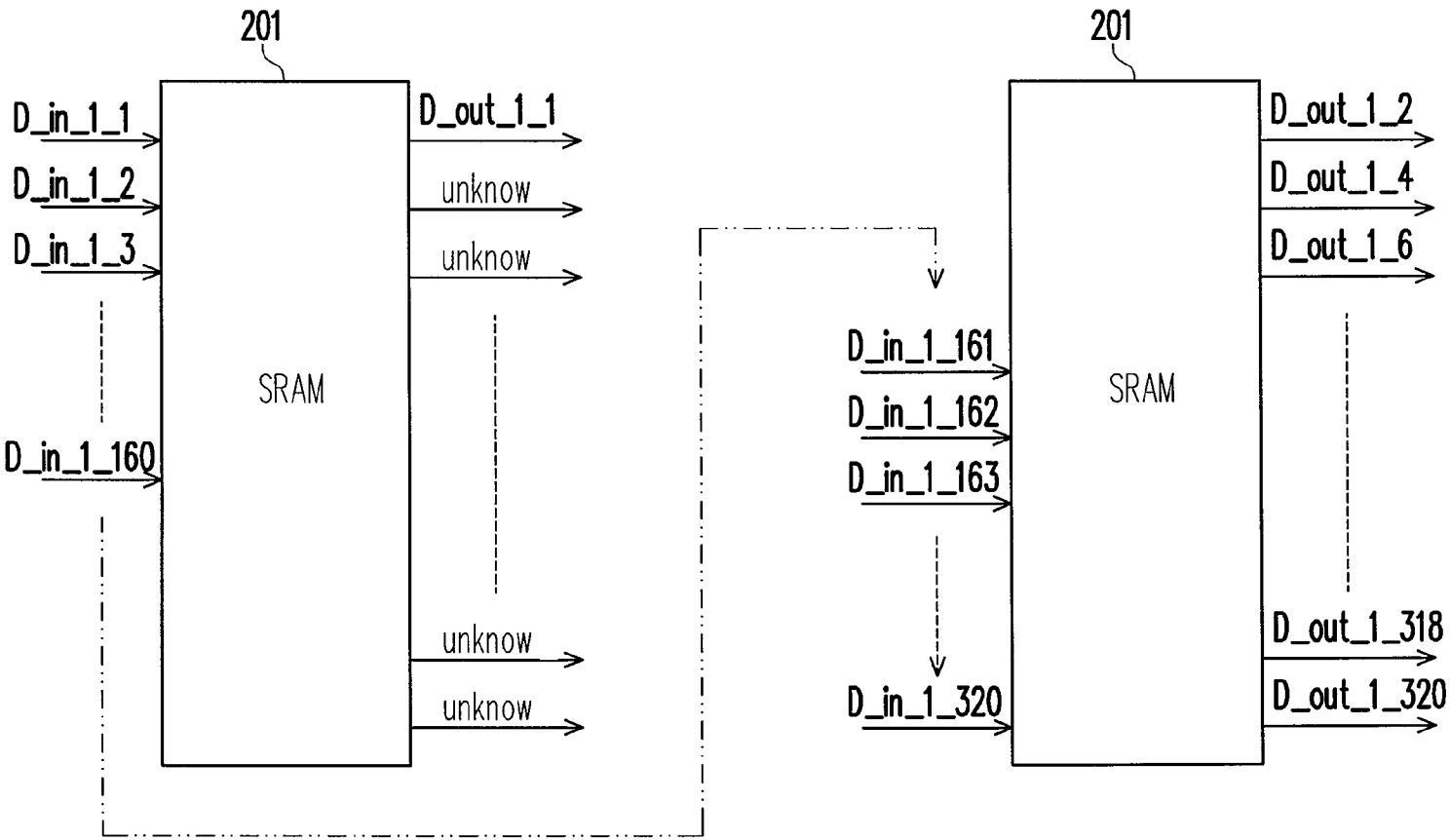
FIG. 2 (PRIOR ART)
FIG. 2 shows the read mode of the conventional memory within the driver for the first frame period when the display panel adopts the interlaced scanning mode as video transmitting method.
Figure 3:
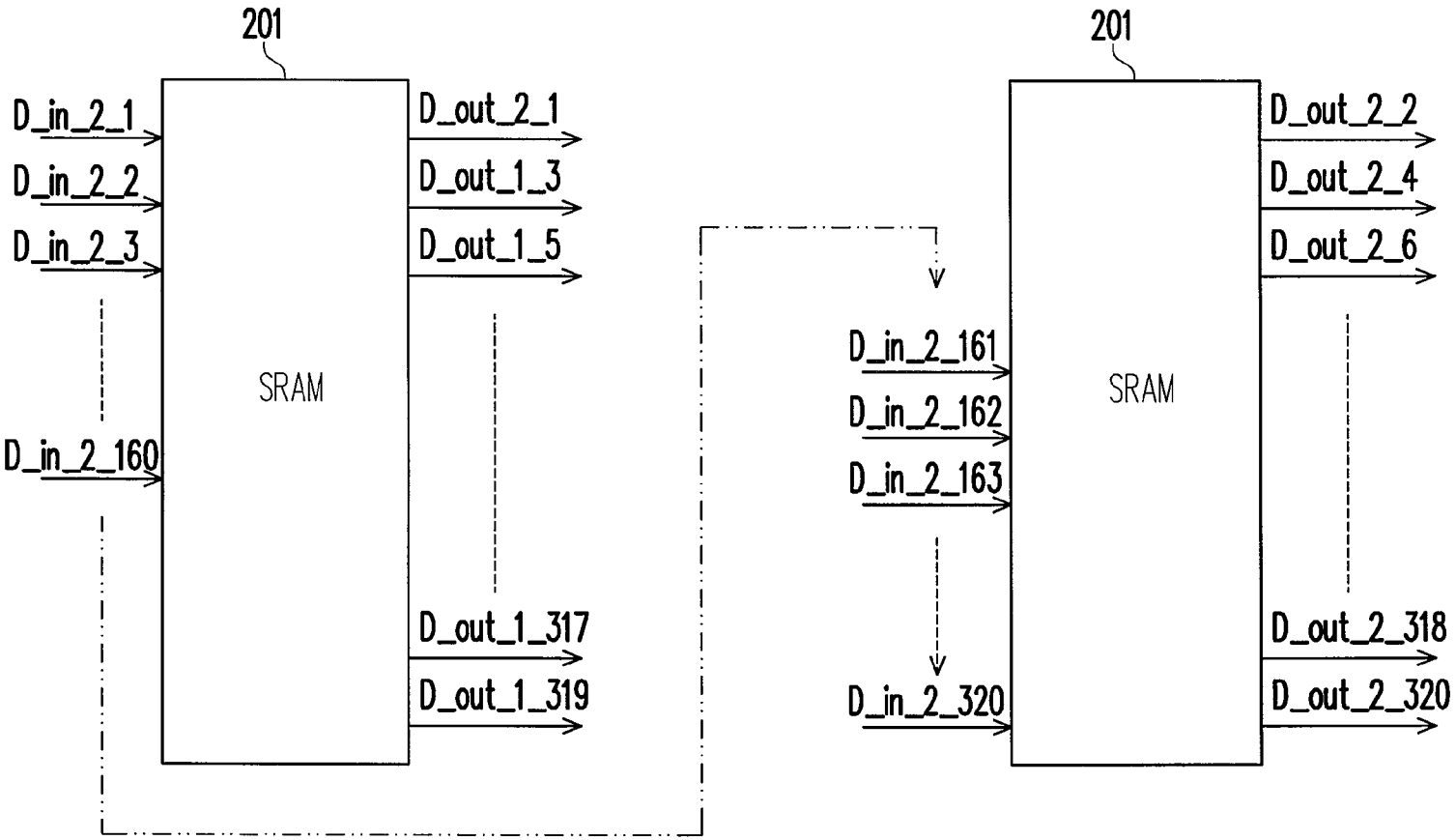
FIG. 3 (PRIOR ART)
FIG. 3 shows the read mode of the conventional memory within the driver for the second frame period when the display panel adopts the interlaced scanning mode as video transmitting method.

Reference will now be made in detail to the present preferred embodiments of the invention, examples of which are illustrated in the accompanying drawings. Wherever possible, the same reference numbers are used in the drawings and the description to refer to the same or like parts.

The object of the present invention is to eliminate the tearing effect when the conventional TFT-LCD is displaying the video animation frame. The present invention can be applied to the memory of the conventional driver without adding any memory. The following content will describe the detail of the present invention to the technical personnel of corresponding field.

Figure 4:
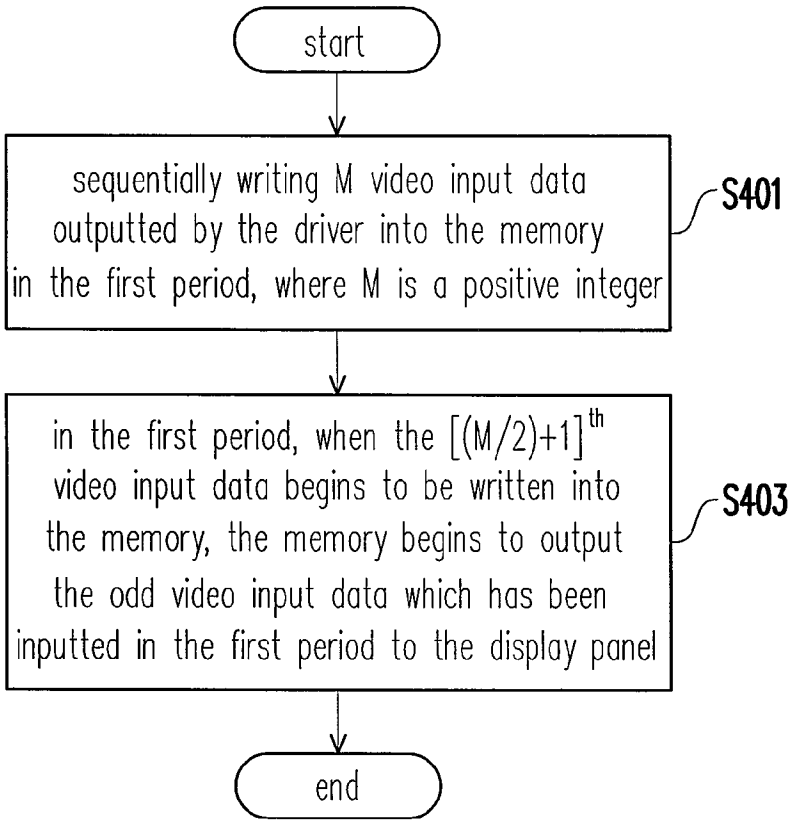
FIG. 4 is a flow chart which discloses a method for reading/writing in memory according to a preferred embodiment of the present invention.

FIG. 4 is a flow chart which discloses a method for reading/writing in memory according to a preferred embodiment of the invention. Referring to FIG. 4, the method for reading/writing in memory comprising the following steps of: firstly, as step S401 described, sequentially writing M video input data outputted by the driver into the memory in the first period, wherein the memory can be a SRAM, a DRAM or a buffer etc, and the M is a positive integer, and then as step S403 described, in the first period, when the $[(M/2)+1]^{th}$ video input data begins to be written into the memory, the memory begins to output the odd video input data which has been inputted in the first period.

According to the above, the most essential difference between said method of the present embodiment and the conventional method is the reading time of the memory. Firstly, it is synchronous for the conventional memory to read/write data, namely, the conventional memory is being read and written at the same time. However, the memory of the present embodiment is being read and written asynchronously, namely, the data will not be read from the memory until a time delay (the time delay should not be restricted to any particular period) from the memory begins to be written in data. That is to say, there is a time delay from the writing time to the reading time. Because of the artful time delay, the memory adopting said reading/writing method can be applied in a conventional driver to eliminate the tearing effect of the conventional TFT-LCD.

It should be emphasized that there is at least N blanking included in the first period, and N is a positive integer or zero. In the blanking the memory will not be read.

Figure 5:
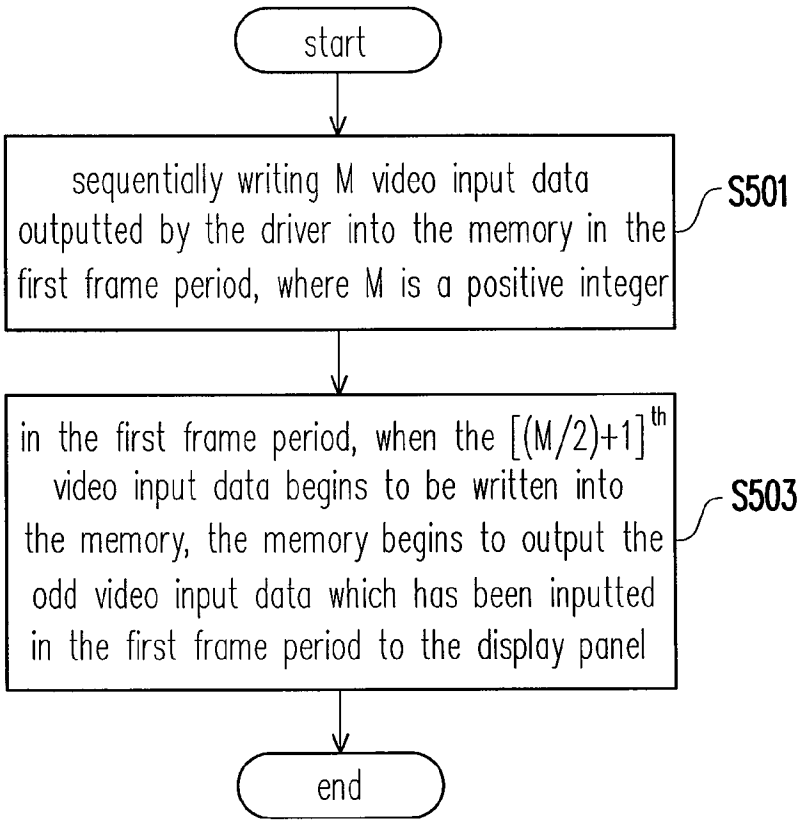
FIG. 5 discloses a method for driving the display panel according to a preferred embodiment.

FIG. 5 discloses a method for driving the display panel according to a preferred embodiment. Referring to FIG. 5, the present embodiment discloses a method for driving the display panel which comprises the following steps of: firstly, as step S501 described, sequentially writing M video input data outputted by the driver into the memory in the first frame period, wherein the memory can be a Static random access memory (SRAM), a Dynamic random access memory (DRAM) or a buffer etc, and the M is a positive integer, and then as step S503 described, in the first frame period, when the $[(M/2)+1]^{th}$ video input data begins to be written into the memory, the memory begins to output (be read) the odd video input data which has been inputted in the first frame period to the display panel.

In this embodiment, when the $M^{th}$ video input data has been written into the memory in the first frame period and after that the first video input data begins to be written into the memory in the second frame period, the memory begins to output the even video input data which has been inputted in the first frame period to the display panel. Moreover, in the first frame period, when the $M^{th}$ video input data has been written into the memory in the first frame period, the memory have finished outputting the odd video input data which has been inputted in the first frame period.

It should be emphasized that there is at least N blanking included in the first frame period and the second frame period, and N is a positive integer or zero. In the blanking the memory will not be read.

For the sake of explaining the present invention expediently, the present embodiment gives an example that the memory is a SRAM, and there is no blanking in the first frame period and the second frame period. However the present invention should not be limited like this embodiment, that is to say, the user can use the other kinds of memory or add some blanking (for example, N=1, 2, . . . ) in the first frame period or the second frame period. On the assumption that M=320, the step S501 can be simply described as: sequentially writing the 320 video input data outputted by the driver into the memory in the first frame period. The step S503 can be simply described as: the memory begins to output the $1^{st}$, $3^{rd}$ . . . video input data to the display panel when the $161^{st}$ video input data begins to be written into the memory in the first frame period.

After that, when the $320^{th}$ video input data has been written into the memory in the first frame period, the memory has finished outputting all the odd video input data which is written into the memory in the first frame period. Namely, the $319^{th}$ video input data of the first frame has been outputted, and when the first video input data of the second frame begins to be written into the memory, the memory will begin to output the $2^{nd}$, $4^{th}$, . . . , $320^{th}$ video input data to the display panel.

Further, according to the essential theory of the present invention, it is feasible to add some blanking in the first frame period and the second frame period. The following content will give some examples of diagrammatic drawings which disclose some embodiments that there is no blanking or some blanking in the first frame period or the second frame period.

Figure 5A:
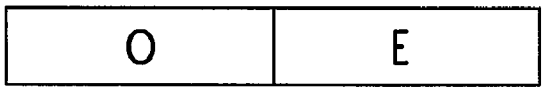
FIG. 5A is a diagrammatic drawing which discloses an embodiment that there is no blanking in the first frame period and the second frame period.

FIG. 5A is a diagrammatic drawing which discloses an embodiment that there is no blanking in the first frame period and the second frame period. Referring to FIG. 5A, it shows that the odd video input data O and the even video input data E which is written into the memory in the first frame period and the second frame period is sequentially. It should be emphasized that the present invention will not be limited to writing the even video input data E after the odd video input data O has been written, that is to say, according to the actual demand the user can write the even video input data E firstly and then write the odd video input data O.

Figure 5B:
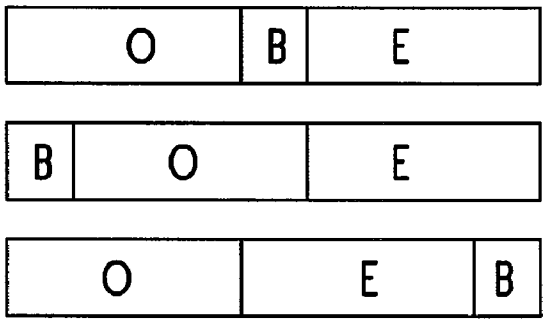
FIG. 5B is a diagrammatic drawing which discloses the present embodiment that there is one blanking B in the first frame period and the second frame period.

FIG. 5B is a diagrammatic drawing which discloses the present embodiment that there is one blanking B in the first frame period and the second frame period. The FIG. 5B clearly shows that both the first frame period and the second frame period comprise one blanking B, and the blanking B can be inserted between the odd video input data O and the even video input data E. The blanking B also can be inserted ahead of or behind of the first frame period or the second frame period. The present invention can not be limited to writing the even video input data E after the odd video input data O has been written, that is to say, according to the actual demand the user can write the even video input data E firstly and then write the odd video input data O.

Figure 5C:
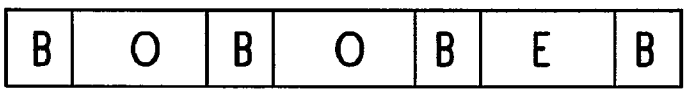
FIG. 5C is a diagrammatic drawing which discloses the present embodiment that there is some blanking B in the first frame period and the second frame period.

FIG. 5C is a diagrammatic drawing which discloses the present embodiment that there is some blanking B in the first frame period and the second frame period. The FIG. 5C clearly shows that both the first frame period and the second frame period comprise some blanking B, for example 4 blanking B, and the blanking B can be inserted between the odd video input data O and the even video input data E. The blanking B also can be inserted ahead of or behind of the first frame period or the second frame period. The present invention can not be limited to writing the even video input data E after the odd video input data O has been written, that is to say, according to the actual demand the user can write the even video input data E firstly and then write the odd video input data O.

According to the above, the display panel of the present embodiment adopts a different driving method to the conventional driving method. The driving method of the present invention is based on the method for reading/writing in memory disclosed in said embodiments. So the driving method of the display panel disclosed in the present embodiment can be applied in the conventional middle size or small size display to eliminate the tearing effect.

Figure 6:
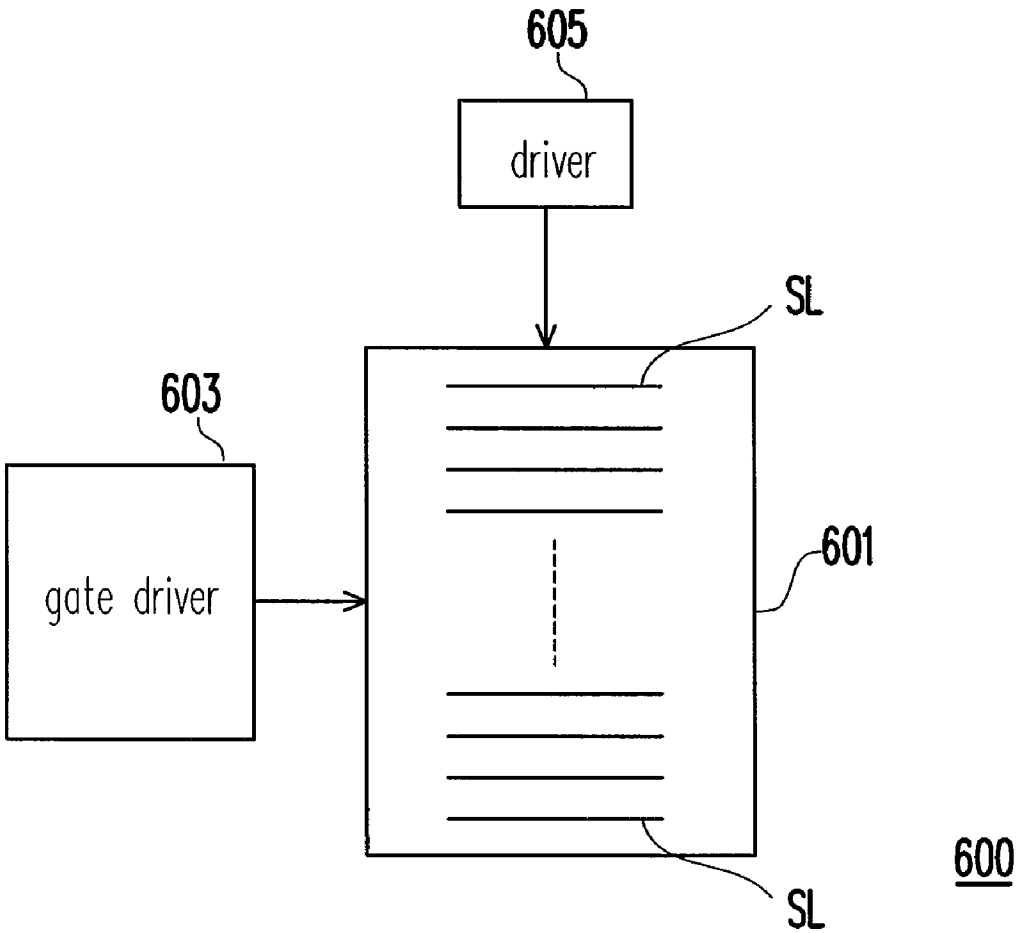
FIG. 6 is a block diagrammatic drawing which discloses a preferred embodiment of the display of the present invention.

FIG. 6 is a block diagrammatic drawing which discloses a preferred embodiment of the display. The display 600 of the present embodiment can be a TFT-LCD which comprises display panel 601, gate driver 603 and driver 605. It should be noticed, the video signal transmitting method of the display panel 601 is a non-sequential transmitting method which can be called interlaced scanning. The display panel 601 comprises M (M is a positive integer) scan lines SL, and it is turned on by the scan signal outputted by the gate driver 603 and corresponding to receive the video input data provided by driver 605.

In the present embodiment, the driver 605 comprises a memory which can be a SRAM (not shown), a DRAM (not shown) or a buffer (not shown) etc. M video input data outputted by the driver 605 is written into the memory sequentially in the first frame period, and in the first period, when the $[(M/2)+1]^{th}$ video input data begins to be written into the memory, the memory begins to output the odd video input data which has been inputted in the first frame period.

Further, when the $M^{th}$ video input data has been written into the memory in the first frame period, the memory has finished outputting all of the odd video input data which is written into the memory in the first frame period, and when the first video input data of the second frame period begins to be written into the memory, the memory will begin to output the even video input data to the display panel 601.

In general, at present when the driver 605 is manufactured, the source driver and the timing controller will be integrated in the driver 605, or further the gate driver 601 can also be integrated in the driver 605. For the sake of not to confuse the essential theory and object, the theory of the working principle of the driver 605 will not be explained. Who has the common sense in this field should know the theory and the effect, so it will not be given unnecessary details here.

It should be emphasized that in present embodiment there is at least N blanking included in the first frame period and the second frame period, and N is a positive integer or zero. In the blanking the memory will not be read.

Furthermore, for the sake of clearly explaining method for reading/writing in memory of said driver 605, the following content will explain it according to the drawing which discloses the method for the reading/writing in memory. The present embodiment gives an assumption that the memory is a SRAM, and there is no blanking in the first frame period and the second frame period. However the present invention should not be limited like this embodiment, that is to say, the user can use the other kinds of memory or add some blanking (for example, N=1, 2, . . . ) in the first frame period or the second frame period.

Figure 7:
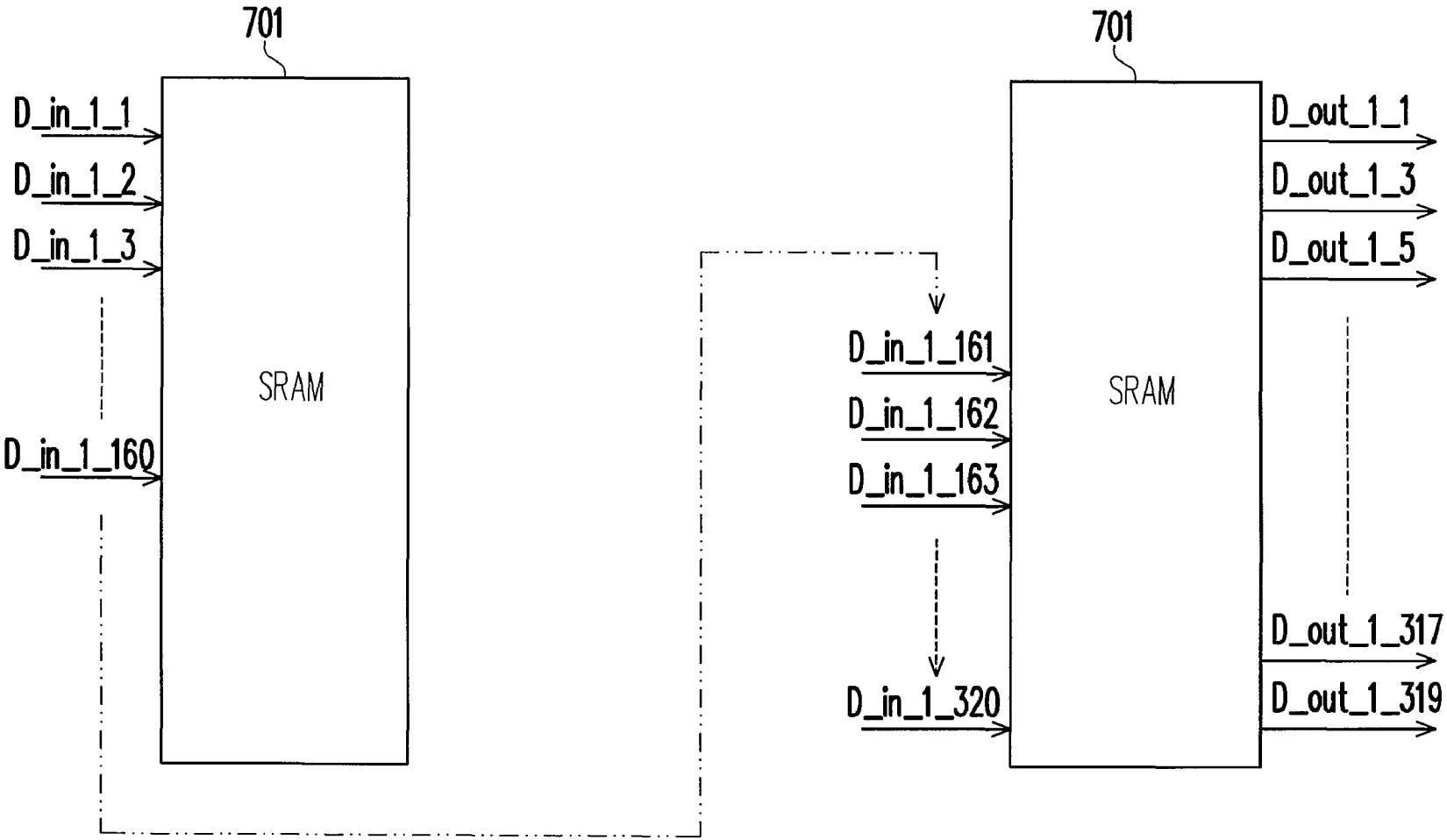
FIG. 7 shows the read mode of the memory of the driver in the first frame period when the display panel of the display adopts the interlaced scanning mode as video transmitting method.

FIG. 7 shows the read mode of the memory 701 of the driver 605 in the first frame period when the display panel 601 of the display 600 adopts the interlaced scanning mode as video transmitting method. Referring to FIG. 6 and FIG. 7, when the interlaced scanning mode is adopted, the read mode of the memory 701 within the driver 605 is: firstly, sequentially writing video input data into the memory 701 from the first video input data D_in_1_1 to the $160^{th}$ video input data D_in_1_160, and at this time, the video input data for odd field will not be outputted to the display panel 601.

After then, when the $161^{st}$ video input data D_in_1_161 of the first frame is written into the memory 701 within the driver 605, the first video input data of the odd field D_out_1_1 will be outputted, that is to say, when the $162^{nd}$ video input data D_out_1_1 to the $320^{th}$ video input data D_in_1_320 is sequentially written into the memory 605 within the driver 605, the sequentially writing the third video input data D_out_1_3, the $5^{th}$ video input data D_out_1_5, . . . of the odd field will be outputted, and $319^{th}$ video input data D_out_1_319 of the odd field will be outputted when the $320^{th}$ video input data D_in_1_320 of the first frame is written.

According to the above, because of artful delaying the read time of the memory 701, it will be different with prior art that the mistake will not happen that the un-know video input data from the third video input data D_out_1_3 to the $319^{th}$ video input data D_out_1_319 of the odd field will be outputted in the first frame period.

Figure 8:
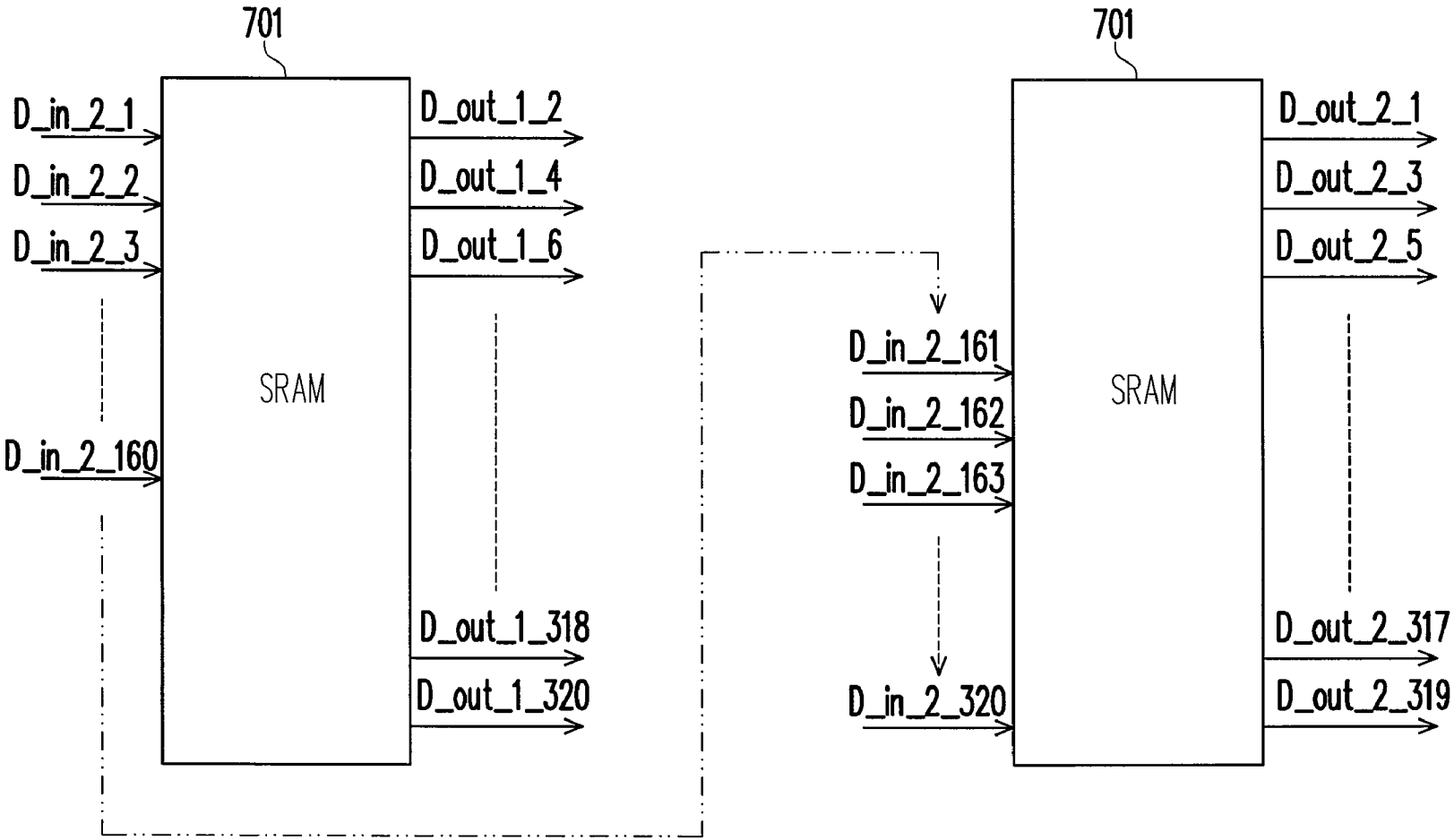
FIG. 8 shows the read mode of the memory of the driver in the second frame period when the display panel of the display adopts the interlaced scanning mode as video transmitting method.

FIG. 8 shows the read mode of the memory 701 of the driver 605 in the second frame period when the display panel 601 of the display 600 adopts the interlaced scanning mode as video transmitting method. Referring to FIG. 6~FIG. 8, succeed to the first frame, when the first video input data D_in_2_1 to the $160^{th}$ video input data D_in_2_160 of the second frame has been written into the memory, all the even video input data of the first frame has been outputted, namely, the second video input data D_out_1_2 to the $320^{th}$ video input data D_out_1_320 of the even field has been outputted.

After then, the first video input data D_out_2_1 of the odd field of the second frame will begins to be outputted when the $161^{st}$ video input data D_in_2_161 of the second frame begins to be written. And then, when the $162^{nd}$ video input data D_in_2_162 to the $320^{th}$ video input data D_in_2_320 of the first frame is written in to the memory 701 within the driver 605, the third video input data D_out_2_3, the $5^{th}$ video input data D_out_2_5 etc will be outputted. And when the $320^{th}$ video input data D_in_2_320 of the second frame is written, the $319^{th}$ video input data D_out_2_319 of the odd field is outputted.

According to the above it can be understood that because of artful delaying the read time of the memory 701, the video input data from the third video input data D_out_1_3 to the $319^{th}$ video input data D_out_1_319 of the odd field in the first frame will not be remained in the second frame as the prior art did. The present invention can eliminate the tearing effect which occurs in the conventional TFT-LCD, and the present invention can be applied in the memory of the conventional drivers which can drive the display panel.

It should be emphasized that in the present embodiment, because of artful delaying the read time of the memory 701, if the interlaced scanning video transmitting method and the line inversion display technology are used at the same time, the AC common voltage applied to the common electrode will only be inverted on each frame, and it is different with the prior: in the prior art if the interlaced scanning video transmitting method and the line inversion display technology are used at the same time, the whole power consumption will be increased because the AC common voltage applied to the common electrode will be inverted on each scan line. So it can be understood that comparing to the conventional TFT-LCD, the whole power consumption of the display 600 described in the present embodiment will be reduced largely.

Furthermore, according to the essential theory of the present invention, it is feasible to add some blanking in the first frame period and the second frame period. The theory has been explained as shown from FIG. 5A~FIG. 5C, so it will not be given unnecessary details here.

According to above, The present invention providing a method for reading/writing in memory can be applied in currently memory within the driver of display panel, and the method for reading/writing in memory can derive from the method for driving display panel, and display of the present invention using the method for driving have the following advantages:

1. The video input data which has been inputted in the first frame period aren't output to the display panel immediately, in the first frame period, after half of data have been written into the memory, the memory begins to output the odd video input data which has been inputted in the first frame period. And when the $M^{th}$ video input data has been written into the memory in the first frame period and after that the first video input data begins to be written into the memory in the second frame period, the memory begins to output the even video input data which has been inputted in the first frame period to the display panel. The method for reading/writing in memory with a reading timing of memory which different than the prior reading timing of memory, which can solve the tearing effect of the prior TFT-LCD, and is applied in memory (such as SRAM) within the driver of display panel.

2. As the driver of display panel provided by the present invention uses the driving method to drive display panel, and the display panel and the display provided by the present invention are employed the driver of the present invention thereof, therefore, the display of the present invention can reduce whole power consumption, and even when the recent video animation frame is being displayed, the display can display a proper video frame to user watched.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for reading and writing a memory, comprising:

sequentially writing M video input data into the memory in a first frame period, wherein M is a predetermined even positive integer;

in the first frame period, when an $[(M/2)+1]^{th}$ video input data begins to be written into the memory, at the same time the memory begins to output an odd video input data which has been inputted in the first frame period; and when an $M^{th}$ video input data for the first frame period has been written into the memory in the first frame period and a $1^{st}$ video input data for a second frame period after the first frame period begins to be written into the memory in the second frame period, the memory begins to output an even video input data which has been inputted in the first frame period.

2. The method according to claim 1, wherein the first frame period comprises at least N blanking therein, and N is a positive integer or zero; and when the $M^{th}$ video input data for the first frame period has been written into the memory in the first frame period, the memory has finished outputting the odd video input data which has been inputted in the first frame period.

3. The method according to claim 1, wherein the memory comprises a Static random access memory, a Dynamic random access memory, or a buffer.

4. A method for driving a display panel, comprising:

sequentially writing M video input data into a memory in a first frame period, wherein M is a predetermined even positive integer;

in the first frame period, when an $[(M/2)+1]^{th}$ video input data begins to be written into the memory, at the same time the memory begins to output an odd video input data which has been inputted in the first frame period to the display panel; and when an $M^{th}$ video input data for the first frame period has been written into the memory in the first frame period and a $1^{st}$ video input data for a second frame period after the first frame period begins to be written into the memory in the second frame period, the memory begins to output an even video input data which has been inputted in the first frame period to the display panel.

5. The method according to claim 4, wherein when the $M^{th}$ video input data for the first frame period has been written into the memory in the first frame period, the memory has finished outputting the odd video input data which has been inputted in the first frame period.

6. The method according to claim 5, wherein the first and the second frame periods comprise at least N blanking therein, and N is a positive integer or zero.

7. The method according to claim 4, wherein the memory comprises a Static random access memory, a Dynamic random access memory, or a buffer.

8. A driver for driving a display panel, comprising:

a driving unit; and a memory for sequentially writing M video input data outputted by the driving unit in a first frame period, and in the first frame period, when an $[(M/2)+1]^{th}$ video input data begins to be written, at the same time the memory begins to output an odd video input data which has been inputted in the first frame period to the display panel, and wherein M is a predetermined even positive integer, wherein an $M^{th}$ video input data for the first frame period has been written into the memory in the first frame period and a $1^{st}$ video input data for a second frame period after the first frame period begins to be written into the memory in the second frame period, the memory begins to output an even video input data which has been inputted in the first frame period to the display panel.

9. The driver according to claim 8, wherein when the $M^{th}$ video input data for the first frame period has been written into the memory in the first frame period, the memory has finished outputting the odd video input data which has been inputted in the first frame period.

10. The driver according to claim 9, wherein the first and the second frame periods comprise at least N blanking therein, and N is a positive integer or zero.

11. The driver according to claim 8, wherein the memory comprises a Static random access memory, a Dynamic random access memory, or a buffer.

12. A display, comprising:

a display panel, and a driver, comprising:

a driving unit; and a memory, sequentially writing M video input data outputted by the driving unit in a first frame period, and in the first frame period, when an $[(M/2)+1]^{th}$ video input data begins to be written, at the same time the memory begins to output an odd video input data which has been inputted in the first frame period to the display panel, and wherein M is a predetermined even positive integer wherein when an $M^{th}$ video input data for the first frame period has been written into the memory in the first frame period and a $1^{st}$ video input data for a second frame period after the first frame period begins to be written into the memory in the second frame period, the memory begins to output an even video input data which has been inputted in the first frame period to the display panel.

13. The display according to claim 12, wherein when the $M^{th}$ video input data for the first frame period has been written into the memory in the first frame period, the memory has finished outputting the odd video input data which has been inputted in the first frame period.

14. The display according to claim 13, wherein the first and the second frame periods comprise at least N blanking therein, and N is a positive integer or zero.

15. The display according to claim 12, wherein the memory comprises a Static random access memory, a Dynamic random access memory, or a buffer.

16. The display according to claim 12, wherein the display panel comprises a thin film transistor liquid crystal display panel or a liquid crystal display panel.

17. The display according to claim 12, wherein the display panel comprises a thin film transistor liquid crystal display or a liquid crystal display.

* * * * *